United States Patent [19]

Loomis

[11] 4,423,896

[45] Jan. 3, 1984

[54] REPLACEMENT HASP, KIT, AND METHOD FOR REPLACING RAILROAD CAR LOCK HASPS

[75] Inventor: Russell M. Loomis, Palos Heights, Ill.

[73] Assignee: Unarco Industries, Inc., Chicago, Ill.

[21] Appl. No.: 241,234

[22] Filed: Mar. 6, 1981

[51] Int. Cl.[3] ..... E05C 19/08

[52] U.S. Cl. ..... 292/284; 29/402.13; 228/192; 292/1

[58] Field of Search ..... 29/402.08, 402.13; 228/192; 292/1, 284, 246

[56] References Cited

U.S. PATENT DOCUMENTS

| | | | |
|---|---|---|---|
| 1,256,117 | 2/1918 | Duncan | 29/485 |
| 3,151,202 | 9/1964 | Russell | 29/402.13 X |
| 3,279,839 | 10/1966 | Madland | 292/284 |

*Primary Examiner*—Richard E. Moore

*Attorney, Agent, or Firm*—Clement and Ryan

[57] ABSTRACT

A replacement hasp for a railroad sliding door lock mechanism, a kit for making the hasp, and method for making the replacement using the kit are disclosed in two embodiments. The kit includes a member which partially defines an eye, sized to fit loosely about the existing hasp-retaining link on the car, and an eye-completion member arrayed to mate with the first member and form a replacement hasp when affixed thereto, as by welding with shear welds. In the first embodiment, the first member is generally U-shaped and the second member includes a tongue portion which mates between the ends of the partial-eye-defining member such that the two can be "telescoped" together to form a replacement hasp of different lengths to accommodate changes in the door or door jamb of the railroad car. The two main members include furrows extending along the parting lines between them so as to aid in welding the main members together and to form a stronger affixture than is possible under the prior commercial practice. The second embodiment is similar to the first but includes a keyway formed through the members and a key which may be inserted when they are mated together in their usual intended position to affix the members together.

9 Claims, 13 Drawing Figures

Fig. 1.
(PRIOR ART)
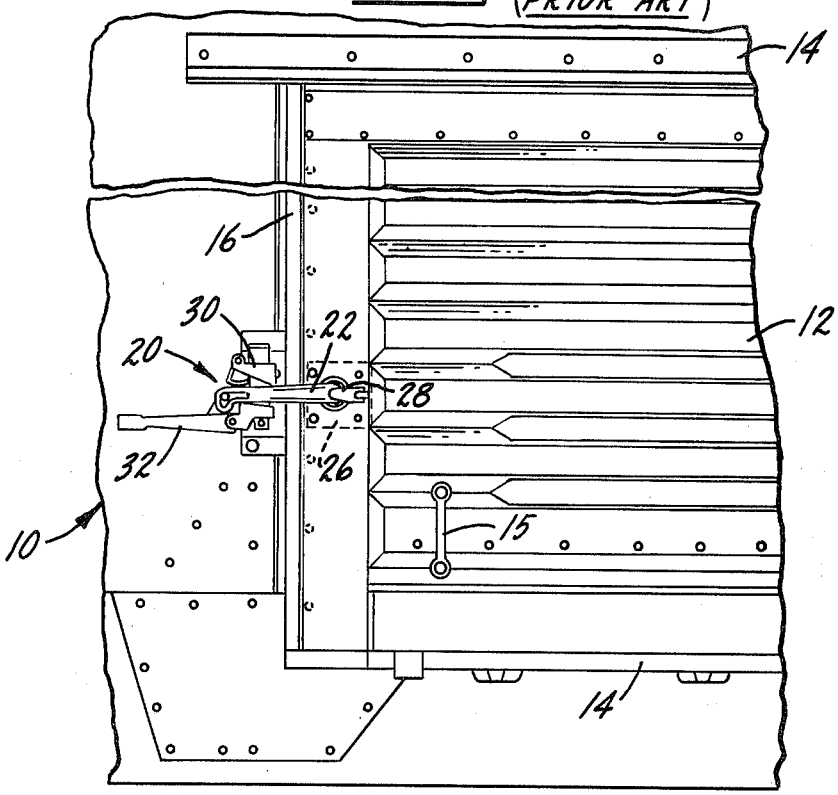
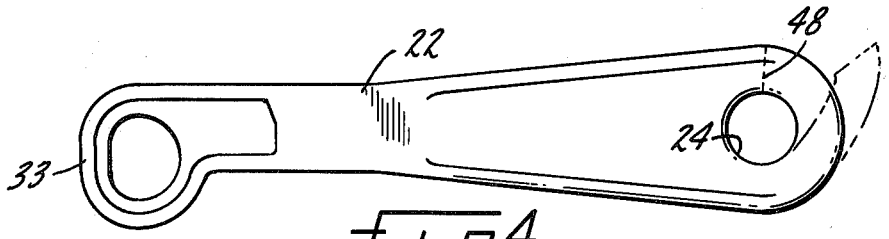
Fig. 4.
(PRIOR ART)
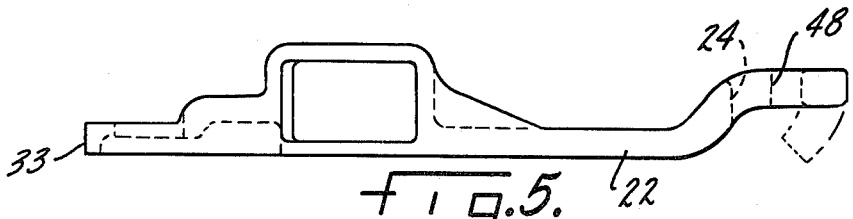
Fig. 5.
(PRIOR ART)

28
24'
92
60
93
61
62
74
91
73
81
72
80
94
75
L
70
33

24'
60
28
61
74
62
84
73
81
72
80
85
75
L'
70
33

60'
101
102
61'
62'
170
74
50'
100
72
70'

28
24'
60
61
74
62
84'
81'
72
80'
85'
70

REPLACEMENT HASP, KIT, AND METHOD FOR REPLACING RAILROAD CAR LOCK HASPS

FIELD OF THE INVENTION

The present invention relates to railroad car sliding door locks and is especially concerned with a new and improved relacement hasp, kit and method for making a replacement hasp on an existing railroad car lock mechanism.

BACKGROUND OF THE INVENTION

From nearly the beginning of railroading, box cars have been employed using sliding doors, and such cars have employed iron or steel hasps in their lock mechanism.

Sliding doors for railroad box cars are typically held closed by an elongated hasp that is rotatably mounted near the leading edge of one sliding door and extends beyond the door to engage a locking mechanism mounted on the door jamb or a second sliding door. The locking hasp is usually mounted with an eye at one end positioned in a hasp fastener so the hasp can rotate both horizontally and vertically about a horizontally disposed link member at the outer end of the fastener. The hasp fastener may be mounted to rotate horizontally about the fitting by which it is secured to the sliding box car door, or the fastner may be secured to the door in a fixed position. A fuller description of such hasps is contained in U.S. Pat. No. 3,279,839.

Sliding box car door hasps are subjected to a good deal of punishment in ordinary use, and it is fairly often necessary to replace broken hasps. In the days when the hasp fasteners and other hardware were bolted to wooden box car doors, it was sometimes possible to unbolt the hasp fastener and replace the hasp and fastener. However, when steel box cars of riveted construction came into use around the turn of the century, the hasp fasteners were frequently secured to the sliding box car doors by rivets or by bolts and nuts that were "chisel checked" to produce fastenings that functioned essentially in the same way as rivets. With this type of construction, it became necessary to chisel off the heads of the rivets or bolts to remove the hasp fastener, and in turn apply a new hasp and re-rivet the fastener.

With the advent of the all-welded car construction in the early 1940's, a new method of hasp replacement was developed. In this method, the eye of the broken hasp was cut open or off with a torch, and the hasp was then removed. The new replacement hasp had to be cut, and bent or twisted open, and then brought into position in relation to the hasp fastener. The free end was then heated, and bent or twisted back into the original shape of the replacement hasp eye. In this position, the hasp eye was welded together.

As will be seen, this method of replacing broken hasps had serious disadvantages. For one thing, it is inconvenient to bend or twist the material forming the hasp eye into shape for welding. For another thing, the resulting weld cannot extend around the entire cross-sectional circumference of the member forming the hasp eye, since access to the inner portion of the hasp eye member is blocked by its proximity to the pin portion of the hasp fastener that supports the hasp.

A second method of removing broken hasps and installing a replacement hasp is to cut the link of the hasp fastener—instead of the eye of the hasp itself—which is then heated and bent open to permit removal of the broken hasp and substitution of a new hasp. The bent link member of the hasp fastener is then heated again and bent into closed position, where it is welded.

This second method has the same disadvantages as the first prior art method, i.e., inconvenience and short length of weld.

For example, with a typical commercial hasp, in both prior art cases the maximum length of weld possible is approximately $1\frac{1}{4}$ inches, and it is a tension weld. This length of weld represents the length of the unobstructed portion of the cross-ssectional circumference of the eye member or the hasp fastener member, as the case may be.

SUMMARY OF THE PRESENT INVENTION

In overcoming the long-standing disadvantages of the prior art methods of replacing hasps, the present invention provides a kit for making a replacement hasp for a damaged or inoperable hasp on a railroad car door assembly of the type which is locked by a lock mechanism which employs a moveable hasp secured by a post or link which passes through an eye formed on the hasp. This link or hasp fastener is permanently attached to the side of the car by means which, as indicated above, typically include rivets or "chisel checked" nuts and bolts.

The kit includes a partial-eye-defining member which is sized and shaped to fit loosely about the link or post and extend therefrom. Also provided is an eye-completion member sized and shaped to mate with said partial-eye-defining member to complete the eye primarily by means of shear welds.

Together these members can form a new replacement hasp in place of an original hasp by positioning the partial-eye-defining member about the link, mating the eye-completion member therewith, and affixing said members together. All of this can be done without severing the link or hasp fastener and without modifying in any way the attachment of both ends of the link to the car side.

The replacement hasp fastener of the present invention has the following advantages:

A. It is more convenient to install the replacement hasp since (1) the replacement member does not have to be heated and bent or twisted, and (2) the link or hasp fastener does not have to be severed, or detached at either end from the car side.

B. The resulting welds provide, in one practical embodiment actually made and tested, about $5\frac{1}{2}$ inches of shear welds (two in front and two in back) and about 1 inch of tension welds on the top and bottom of the invention hasp.

C. If desired, the over-all length of the hasp can be increased while it is being installed. This may be desirable if the leading edge of the sliding box car door and the edge of the other box car door (or the door frame) have been pushed out of alignment with each other. Since the length of the welds possible with the replacement hasp of this invention is quite large, it is acceptable to reduce the length of the shear welds by thus adjusting the length of the replacement hasp.

The invention, together with the advantages thereof, may best be understood by reference to the following description taken in connection with the accompanying drawings, in the several figures of which, like reference numerals identify like elements.

BRIEF DESCRIPTION OF THE FIGURES

FIG. 1 is a side-elevational, fragmentary view of a conventional railroad car, including a sliding door and its associated door lock mechanism, which view is useful in understanding the environment of use of the present invention.

FIG. 4 is an elevational side view of one conventional part, a hasp, which may be employed as a replacement for a worn, damaged or broken hasp of the lock mechanism illustrated in FIGS. 1–3, wherein a modification of the eye of the hasp is shown in dashed outline.

FIG. 5 is a top view of the hasp of FIG. 4 wherein a slightly different modification of the eye of the hasp is indicated in dashed outline.

The devices shown in FIGS. 1 through 5 are, as explained below, conventional prior art devices.

Figure 6:
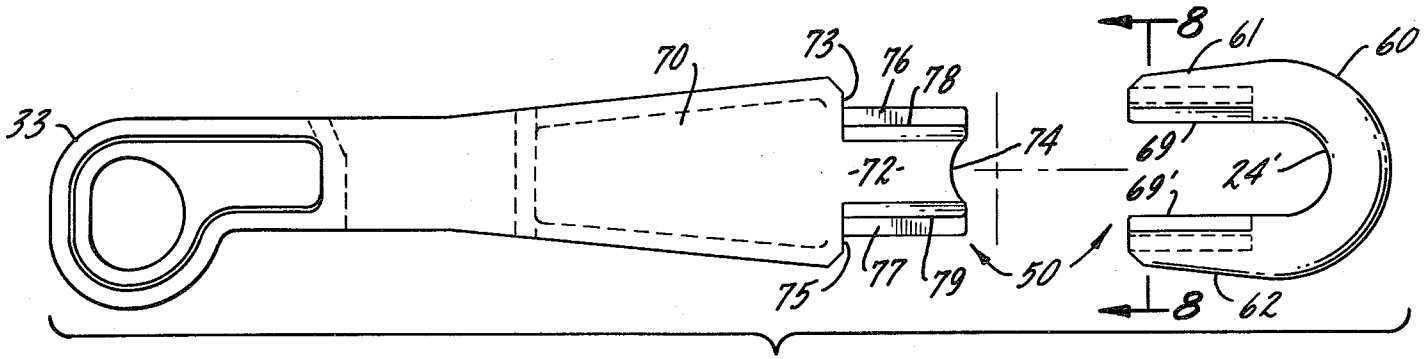

FIG. 6 is a side-elevational view of a kit for making, in accordance with the present invention, a replacement hasp. The hasp kit includes two parts: a partial-eye-defining member of a generally U-shape, and an eye-completion hasp body member.

Figure 7:
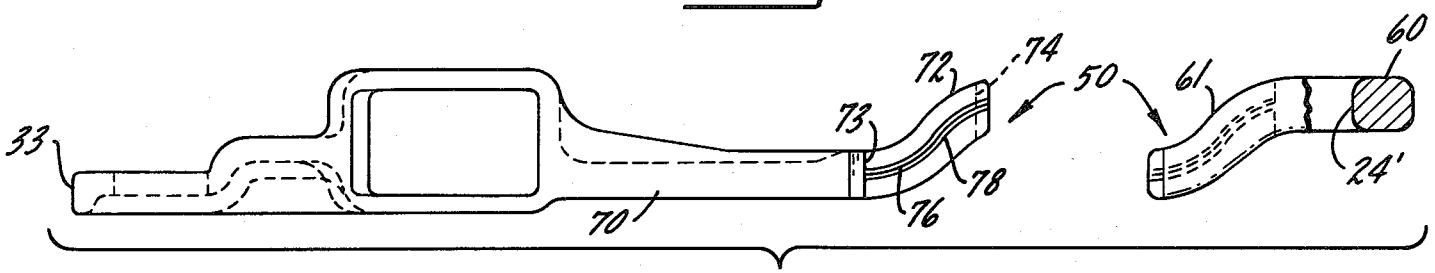

FIG. 7 is a top view of the kit of FIG. 6, partly in section.

Figure 8:
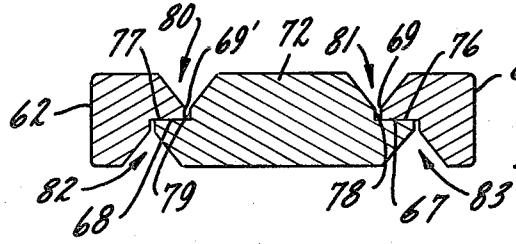

FIG. 8 is a sectional view of the kit of FIGS. 6 and 7, wherein the parts are mated together, generally as seen from the plane of line 8—8 of FIG. 6 when looking in the direction of the arrows.

Figures 9, 10, 11, 12:
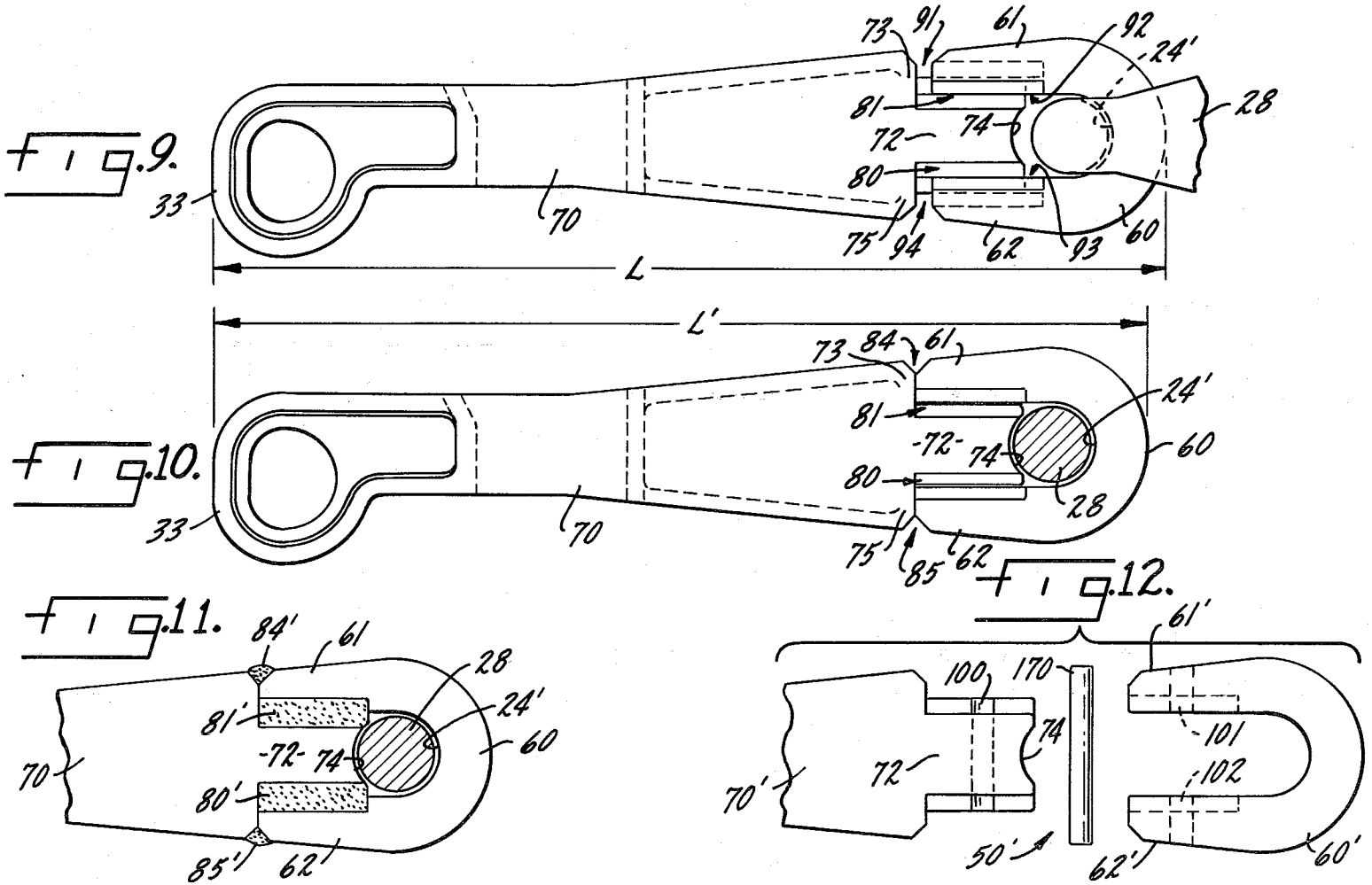

FIG. 9 is a side-elevational view of the replacement hasp kit of FIGS. 6–8, positioned on the lock mechanism, illustrating the method of assembly and telescoping relationship between the parts of the kit.

FIG. 10 is a side-elevational view of the hasp kit of FIGS. 6–9, illustrating the relationship between the parts of the kit when fully mated together.

FIG. 11 is a partial view similar to that of FIG. 10 showing the fully assembled and affixed kit as a finished replacement hasp constructed in accordance with the present invention.

FIG. 12 is a partial side-elevational view, similar to that of FIG. 6, of an alternative construction of the hasp kit, which kit includes, as a third part, a key member.

Figure 13:
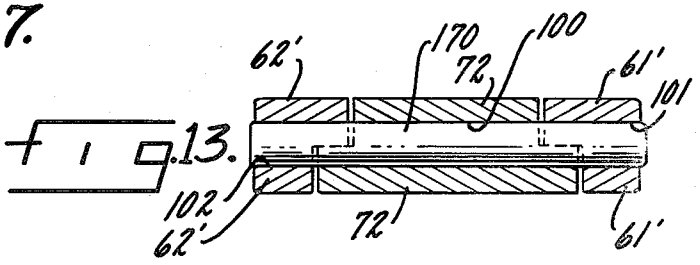

FIG. 13 is a sectional view, similar to that of FIG. 8, of a completed hasp made from the kit of FIG. 12, the sectional view being taken through the key member.

DETAILED DESCRIPTION OF THE INVENTION

Referring to FIG. 1, there is depicted a portion of a railroad car 10 which includes a sliding door 12. The door 12 slides in top and bottom tracks 14 and usually includes a handle 15 and roller mechanism (which is not illustrated) for being manually opened and closed. In this car 10 only one sliding door 12 is provided which is shown in its closed position against a door jamb 16 which is part of the fixed sidewall of the car 10.

Figure 2:
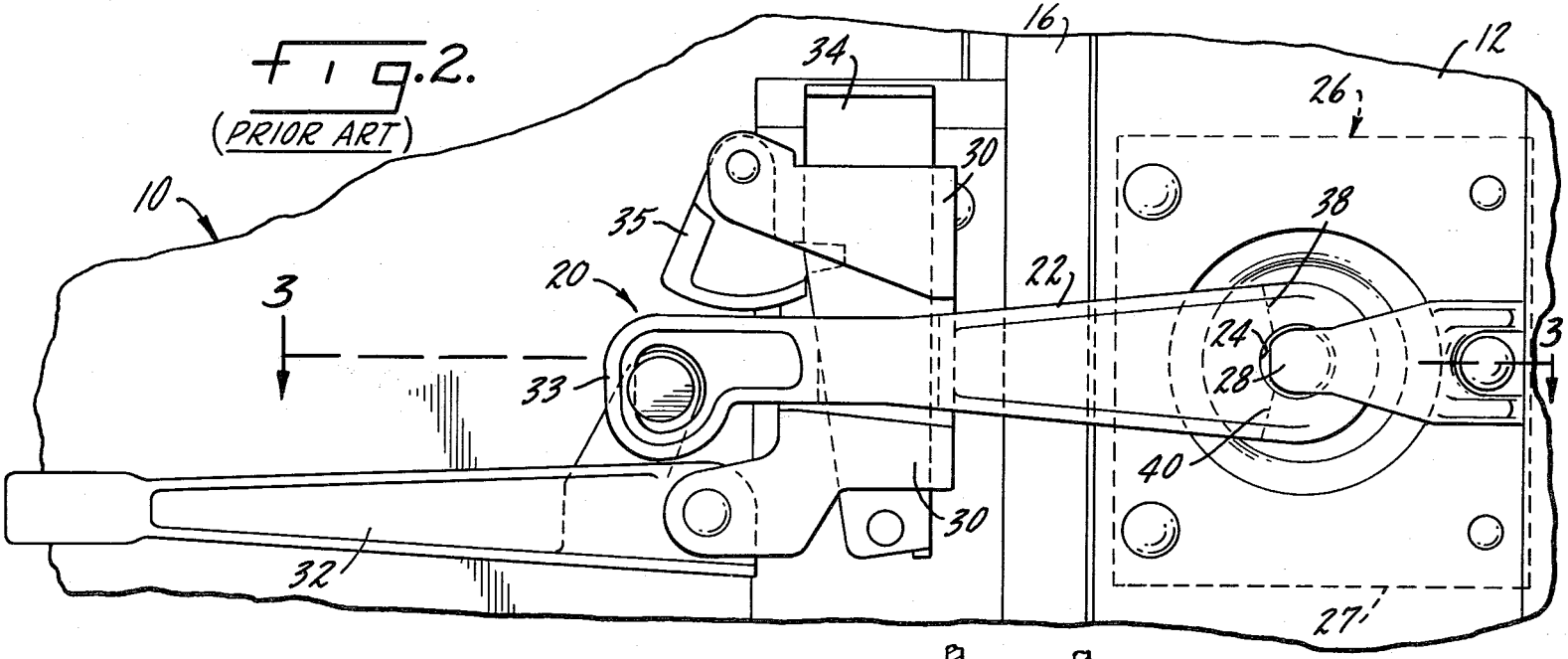
FIG. 2. (PRIOR ART)
FIG. 2 is an enlarged and more detailed elevational view of the lock mechanism and related parts of the railroad car of FIG. 1.
Figure 3:
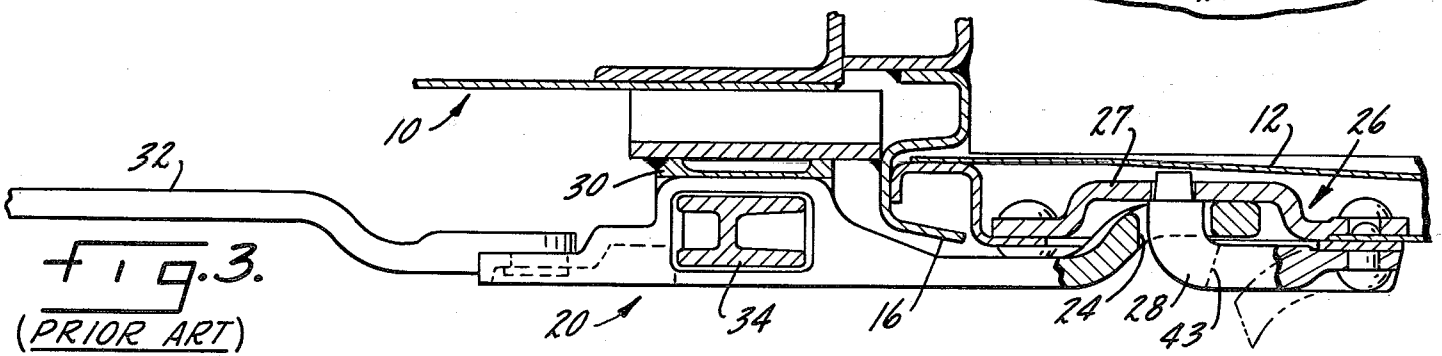
FIG. 3. (PRIOR ART)
FIG. 3 is a sectional view of the lock mechanism and related parts of FIG. 2 as seen from the plane of line 3—3, when looking in the direction of the arrows, on FIG. 2, with the cut and moved position of one part shown in dashed outline.

Such doors 12 are secured in their closed position by means of a lock mechanism, generally designated 20, and shown in more detail in FIGS. 2 and 3. Referring to those Figures, it can be seen that mechanism 20 includes a hasp 22 which is an elongated member or arm having an eye 24 formed at one end. A hasp fastener 26 is provided which includes a back plate 27 secured by rivets or otherwise to the door 12. The fastener 26 secures the hasp by means of a horizontally disposed pin or link 28 which passes through the eye 24 of the hasp 22. The pin or link 28 is shaped into a horizontally curving or bight section that extends from the plate 27 back to it and is either formed unitarily therewith or securely riveted through the wall to the backplate.

The hasp eye 24 is larger than the link 28 so as to allow the hasp 22 to easily turn or pivot thereon and also to be moved both forward along as well as around the curving link or pin 28.

Secured to the door post or jamb 16 is a hasp-receiving locking member 30 which forms a generally U-shaped channel in which the hasp is received. Many conventional railroad cars are provided with two sliding doors such as the door 12. In such cars, the locking member 30 is affixed to one door and the hasp to the second door.

Mounted to the locking member 30, for pivotal motion in a vertical direction, is a lever handle 32 which may releasably engage a ring 33 formed at the end of the hasp when the door 12 is nearly closed, and by manually pivoting it downward, move it and the door 12 into its full closed position.

A removable wedge or lock pin 34, sized and shaped to fit through openings formed in both the lock mechanism and the hasp in its closed position in the channel of member 30, completes the basic lock mechanism 20. (An optional pin-holding latch cam 35 can be further provided.)

The lock mechanism 20 so far described and depicted is conventional and has been in use in this industry, with minor modifications and improvements, for many years. Reference may be had to other sources for a more detailed discussion, one being U.S. Pat. No. 3,279,839.

While such mechanisms have been generally successful, they have had problems. One of these problems has to do with the hasp 22. Such hasps are, in use, subject to considerable force and wear. Further, in the environment of use, they can become damaged or broken. And they are even deliberately cut in half, e.g. by hacksaws, by those seeking illegal entry into the cars.

The most common conventional manner of removing and replacing a worn, damaged, or broken hasp, is to cut off the old hasp, if necessary, at the edge, e.g. at dashed lines 38 and 40 of FIG. 2 and remove it.

Referring to FIGS. 4 and 5, there are depicted the conventional hasp 22 and two methods of opening the eye 24 of such a hasp for use as a replacement. In FIG. 4, the eye 24 is cut along line 48 by use of a saw or narrow cutting torch and the eye-forming metal (normally steel) is thereafter heated and bent outward as shown in dashed lines Alternatively, as shown in dashed lines in FIG. 5, the metal eye portion can be heated and twisted outward. Of course, both may be used as long as an opening sufficient to allow the open eye to fit over the pin or link 28 is provided.

The open-eyed hasp is then placed on the link 28 and while still hot, or after reheating, bent back to approximately its original position. It is then necessary to weld the hasp, as best one can, along the line 48.

However, the above-described method has certain serious disadvantages. It is inconvenient to bend or twist the material into the proper shapes. Also, the resulting weld cannot normally extend fully about the cut 48 since it is very difficult to weld the area adjacent to the link 28. (Of course, one has to be careful not to weld the hasp 22 to the link 28 as it is necessary for the hasp to rotate thereon.)

An alternative conventional method is to cut the bar or link 28, at e.g. the plane of line 43 of FIG. 3, heat and bend it outward to the approximate position, as illustrated by phantom lines in FIG. 3, remove the old hasp, insert a new hasp 22, rebend the link 28 and then form a weld around the link 28 at line 43, as best one can. Again, it is relatively inconvenient to bend the link, and the closeness of the eye 24 of the hasp 22 prevents or makes difficult the welding of the inner portion along line 43, adjacent to the eye 24. Also, a relatively short weld length is achieved.

For example, with a typical commercial hasp, the maximum length of weld possible is approximately $1\frac{1}{4}$ inches and it is a tension weld. This length of weld represents the length of the unobstructed portion of the cross-sectional circumference of the eye member or the hasp fastener link member, as the case may be.

The present invention overcomes the drawbacks of the prior art hasp replacement discussed above.

Referring to FIGS. 6 and 7, there is depicted a replacement hasp kit generally designated 50, constructed in accordance with the present invention. The kit 50 includes a partial eye-defining member 60, which is generally U-shaped with an inner wall 24', and an eye-completion member 70. As best seen in FIG. 7, the arm 62 and the tongue 72 have conforming profiles.

The remainder of the hasp body or completion member 70 is formed to resemble a conventional hasp, with portion 74 curved at the same curvature as inner wall 24', and as best shown in FIGS. 6 and 8, a pair of oppositely disposed longitudinally extending flat parallel surfaces 76, 77, which form a corner with longitudinally extending parallel surfaces 78, 79. The arms 61 and 62 have surfaces 67, 68, 69 and 69', which, as shown in FIG. 8, conform to and can abut against the surfaces 76, 77, 78, and 79, respectively, when the tongue is received by the arms 61 and 62. That is, the tongue and arm surfaces substantially conform to each other and mate together.

As best seen in FIGS. 9 and 10, the members 60 and 70 can mate together over a range of positions, and over that range, the length (L or L') of the hasp formed thereby can telescope over a range of lengths.

As shown best in FIG. 8, the edges of the arms 61 and 62 and tongue 72 are, at the parting line between the mating surfaces, bevelled to form V-shaped troughs or furrows 80, 81 on one side and similar furrows 82, 83 on the other side.

As best shown in FIG. 10, the transverse surfaces at the end of the arms 61, 62 and at the shoulders 73, 75 formed at the base of the tongue 72, are similarly bevelled to form transverse V-shaped troughs or furrows 84, 85 when the parts are mated together in preparation for welding.

The furrows serve as means for allowing the members 60 and 70 to be affixed together by welding as shown in FIG. 11 with the welds designated 80', 81', 84', and 85' corresponding to the respective, similarly numbered troughs. Welds 84' and 85' are tension welds, and welds 80' and 81' are the stronger type shear welds. Additional welds are, of course, made in the furrows 82 and 83 on the opposite side of tongue 72 (FIG. 8).

When it is desired to affix the members 60 and 70 together in a telescoped arrangement such as that shown in FIG. 9, the furrows designated 91, 92, 93 and 94 formed between the ends of the arms 61 and 62 and the tongue 72 serve to receive the weld. Note that these are approximately the same size as the other furrows.

The resulting welds provide, in one practical embodiment actually made and tested, about $5\frac{1}{2}$ inches of shear welds (two in front and two in back) and about 1 inch of tension welds on the top and bottom of the invention hasp, when in the normal replacement arrangement, as shown in FIG. 11.

If desired, the over-all length of the hasp can be increased while it is being installed. This may be desirable if the leading edge of the sliding box car door and the edge of the other box car door (or the door frame) have been pushed out of alignment with each other. Since the length of the welds possible with the replacement hasp of this invention is quite large, it is acceptable to reduce the length of the shear welds by thus adjusting the length of the replacement hasp. And, as shown in FIG. 9, if the length is increased sufficiently, additional welding may take place at areas 91, 92, 93 and 94 to make up for some of the shorter length of the furrows 80 and 81 in this arrangement.

As mentioned before, this compares well with a typical prior art replacement, such as those shown in FIG. 3 or 4, wherein, for a similar sized hasp, a weld length of only $1\frac{1}{4}$ inches can be achieved. This was, of course, a tension weld; that is, a weld which is primarily subject to tension forces in use, whereas the present invention provides welds of not only relatively longer length but of both tension and shear.

Referring to FIG. 12, a modified kit 50' is there depicted. This kit 50' includes a modified partial eye-defining member designated 60' and a modified completion member 70'. In this embodiment, the tongue 72 of the eye closure member 70' is modified by the provision of a circular keyway 100 and the arms 61 and 62 of the partial eye-defining member 60' are modified by the provision of keyways 101, 102. A cylindrical key 170 forms a third part of the kit 50'. The keyways 100, 101, 102 are positioned so as to be aligned with one another when the member 60' is fully seated on the member 70' (in the manner of the members 60 and 70 of FIG. 10). As may be seen best in FIG. 13, the key 170 is sized so as to be received in a press fit in all three keyways 100, 101, and 102 when so aligned. In length, the key 170 is the same as the combined lengths of the keyways 100, 101, 102 so that it can be seated flush with the outer edges of members 61' and 62'.

In the use of the kits 50 or 50', and in accordance with the present invention, the following steps are performed. The old hasp (e.g. of FIG. 2) is cut off in the conventional manner. Then the member 60 or 60' is placed around the link 28 with its arms 61, 62 extending outward and the link 28 seated against the conformingly shaped inner wall of the member 60 or 60', as shown in FIG. 9. The member 70 is then positioned with the tongue 72 within the arms 61, 62 to mate with the member 60 as shown in FIG. 9 or 10.

At this point, the door 12 should be closed tight against the jamb 16 (FIG. 1) and the length of the hasp 50 checked against the mechanism 20. In most cases, the standard length will be adequate (FIG. 10), but in some cases deformities in the door or jamb may make it desirable to have the hasp longer (as in FIG. 9). With the embodiment of either FIG. 9 or FIG. 10, the elements 60 and 70 are secured together by welding them along the furrows and positions indicated above. In the case of kit 50′, the fully mated position must be used, and the key is inserted and positioned, as by hammering.

While two particular embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention.

I claim:

1. A kit for making a replacement hasp for a damaged or inoperable hasp on a railroad car door assembly of the type which is locked by a lock mechanism which employs a movable hasp secured to said railroad car by a link which passes through an eye formed on the hasp, which link is permanently attached at both its ends to the car side, comprising:

a partial-eye-defining member which is sized and shaped to fit loosely about the link and extend therefrom, said partial-eye-defining member being generally U-shaped with two approximately parallel arms defining an opening;

and an eye-completion member sized and shaped to cooperate with said partial-eye-defining member to complete the eye when affixed thereto and to form a complete replacement movable hasp when mounted to the link, said eye-completion member having two approximately parallel surfaces to mate with said approximately parallel arms of said partial-eye-defining member and be welded thereto to form shear welds, whereby a new replacement hasp may be formed in place of an original hasp by positioning the partial-eye-defining member about the link, mating the eye-completion member therewith and affixing said members together at least primarily by means of shear welds, all without severing the link or modifying in any way the attachment of both ends of said link to the car side.

2. The invention of claim 1 wherein the hasp partial-eye-defining member and the hasp eye-completion member may be positioned and affixed in one of at least two different mating positions to selectively produce a completed hasp of at least two different lengths.

3. The invention of claim 2 wherein the eye-completion member and the hasp partial-eye-defining member may be positioned in a mating arrangement over a range of positions wherein the hasp can telescope in length before its said two members are affixed together, to achieve any desired length within a range of lengths so as to accommodate variations in the door to which it may be affixed.

4. The kit as defined in claim 1 wherein said partial-eye-defining member and said eye-completion member mate along longitudinally extending contacting surfaces and define between them longitudinally extending weld receiving furrows.

5. The kit as defined in claim 1 wherein said eye-completion member has a pair of extending shoulder stops for receiving the ends of the arms of said U-shaped member at one end position of the range of positions wherein they can be mated together and said shoulders and ends define transverse weld receiving furrows.

6. The kit as defined in claim 1 which further includes a key and said members each define a keyway for receiving the key when said members are mated together, whereby the key may secure the said members together.

7. The method of replacing a worn or damaged hasp on a railroad car door assembly of the type wherein the hasp is secured to a link that is permanently attached at both its ends to the car side, which method is carried out by use of the kit of claim 1, and in which method the link is neither severed nor is the attachment of said link ends to the car side modified in any way, comprising the steps of:

(a) removing the old hasp, (b) placing the partial-eye-defining member about the link, (c) positioning the eye-completion mamber so as to close the eye formed by the partial-eye-defining member about the link with said two approximately parallel arms of the partial-eye-defining member mated with said two approximately parallel surfaces of the eye-completion member, and (d) securing the partial-eye-defining member and the eye-completion member together at least primarily by means of shear welds.

8. The method of claim 7 wherein the members mate together in a telescoping relationship and the length of the hasp may be varied by causing the members to telescope into or out of each other, wherein after step (c) and before step (d) the following step is performed:

adjusting the telescope mating relationship between the members so that the hasp is of the proper length to fit the particular door assembly such that after securing the members together about said link, the hasp will aid in securely latching and locking the door in its closed position.

9. A replacement hasp for a railroad car door, said hasp being secured to said car by a link attached at both its ends to the car side, comprising a generally U-shaped eye member having generally parallel arms which are shaped to provide longitudinally parallel extending surfaces and an eye-completion member including a tongue having longitudinally extending parallel outer surfaces which mate with and are received by said longitudinally parallel extending surfaces of the arms of the U-shaped eye member, said mating surfaces having longitudinally extending parting lines along which the mating surfaces abut, said eye-completion member having a shoulder on either side of said tongue, the ends of said generally parallel arms of said U-shaped member and said shoulders of said eye-completion member having transversely extending parting lines along which said ends of the U-shaped eye member abut against said shoulders of the eye-completion member, said U-shaped eye member and said eye-completion member being welded together with shear welds along said longitudinal parting lines and with tension welds along said transverse parting lines.

* * * * *